US005590702A

United States Patent [19]

Schenk

[11] Patent Number: 5,590,702

[45] Date of Patent: Jan. 7, 1997

[54] SEGMENTAL CASTING DRUM FOR CONTINUOUS CASTING MACHINE

[75] Inventor: Raymond L. Schenk, Marysville, Mich.

[73] Assignee: Venture Enterprises, Incorporated, Grosse Pointe, Mich.

[21] Appl. No.: 492,480

[22] Filed: Jun. 20, 1995

[51] Int. Cl.[6] ..... B22D 11/06

[52] U.S. Cl. ..... 164/429; 164/479

[58] Field of Search ..... 164/429, 448, 164/442, 428, 443, 485, 479, 480

[56] References Cited

U.S. PATENT DOCUMENTS

| | | |
|---|---|---|
| 4,016,633 | 4/1977 | Smith et al. . |
| 4,122,890 | 10/1978 | Atkins et al. . |
| 4,349,067 | 9/1982 | Wirtz et al. . |
| 4,415,016 | 11/1983 | McLane et al. . |
| 4,489,772 | 12/1984 | McLane et al. . |
| 4,509,581 | 4/1985 | McLane et al. . |
| 4,534,404 | 8/1985 | McLane et al. . |
| 4,544,014 | 10/1985 | McLane et al. . |
| 4,545,422 | 10/1985 | McLane et al. . |
| 5,497,822 | 3/1996 | Schenk ..... 164/479 |

*Primary Examiner*—Joseph J. Hail, III
*Assistant Examiner*—I.-H. Lin
*Attorney, Agent, or Firm*—Harness, Dickey & Pierce, P.L.C.

[57] ABSTRACT

A continuous casting machine is disclosed of the type having a rotary casting drum with a mold cavity machined thereon, and a shoe in close engagement with the mold cavity so as to disperse molten media therein. The casting drum is formed from a series of ring segments that are interconnectable to form a shell having any desired width. By adding or subtracting ring segments, the width of the shell can be adjusted to the desired production specifications. In addition, a pressure control system is provided which is placed in fluid communication with the mold cavity via flow pathways through the casting drum upon rotation thereof. The pressure control system is operable for evacuating the mold cavity just prior to dispersion of molten media therein, and for subsequently ejecting the cast product upon solidification thereof.

25 Claims, 3 Drawing Sheets

92
104
VACUUM SOURCE
102
102
96
24
26
94
94
4
62
63
60
54
16
58
66
56
14
64
66
56
50
52
58
52
60
82
88
82
88
116
116
63
62
120
118
122
78
26
28
70
26
78
PRESSURE SOURCE
124
126
124

Fig-4
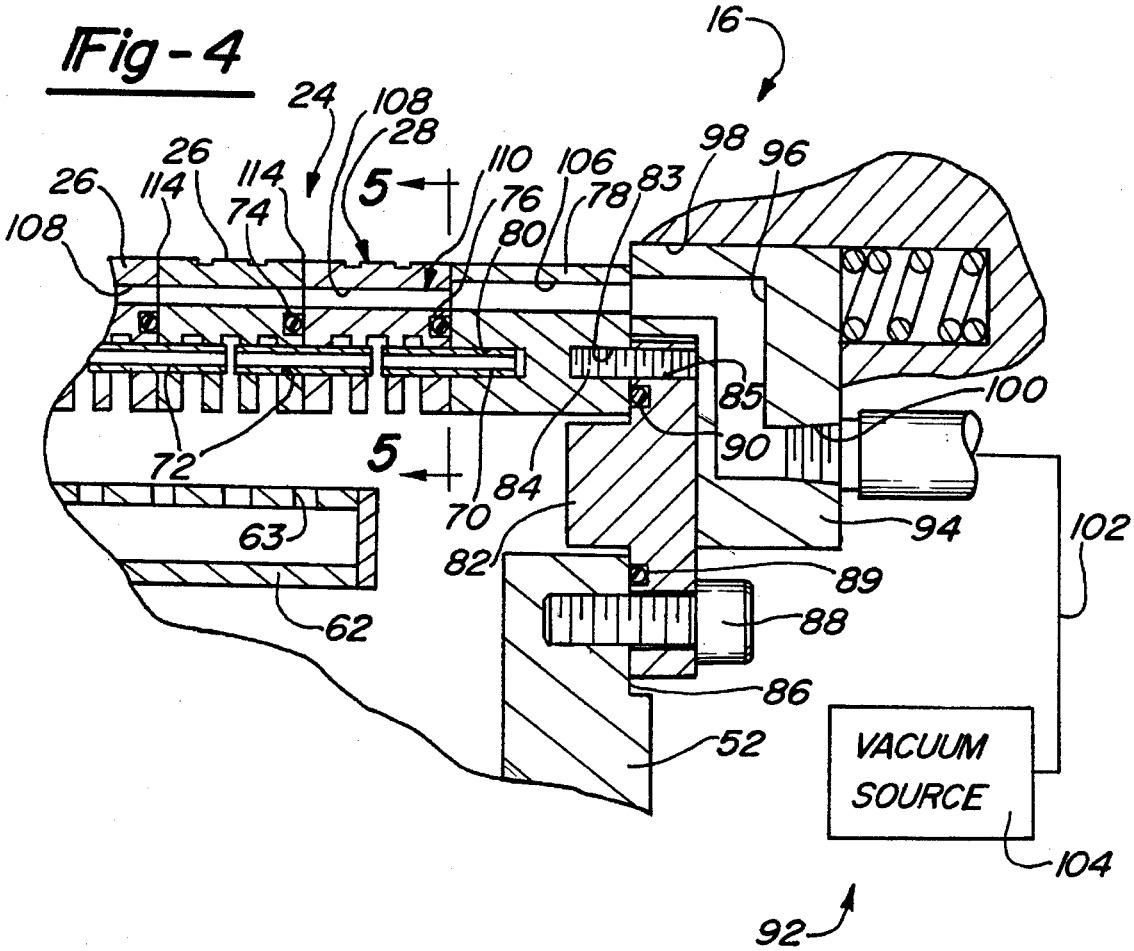
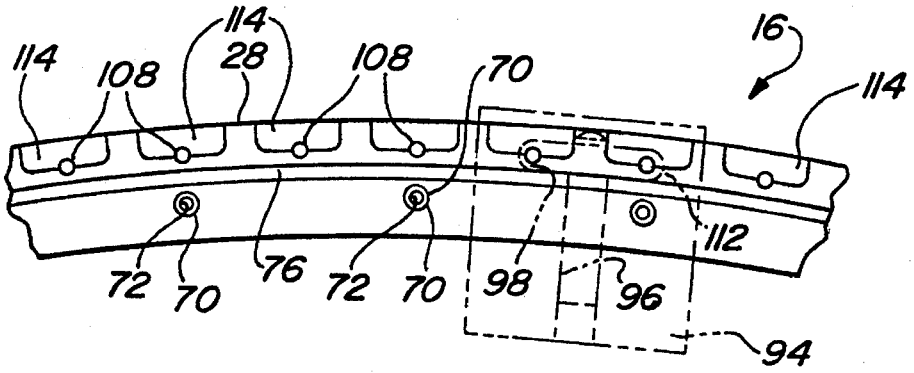
Fig-5

SEGMENTAL CASTING DRUM FOR CONTINUOUS CASTING MACHINE

BACKGROUND OF THE INVENTION

The present invention relates to casting drums for use on continuous casting machines and, more particularly, to a segmental casting drum that is operably associated with a pressure control system for evacuating the mold cavity prior to casting and subsequently pressurizing the mold cavity to eject the cast product therefrom.

A large percentage of the battery grids used in commercially-available lead-acid batteries are currently manufactured by a continuous casting (i.e., "con-cast") process. Traditional continuous casting machines include a rotary drum having a patterned mold cavity (i.e. a reticulated grid pattern) engraved into its outer peripheral surface, and a stationary shoe having an arcuate surface which overlays a limited portion of the mold cavity. The molten lead alloy is discharged through an orifice slot in the shoe such that it is directed into the mold cavity as the casting drum rotates past the shoe. Due to rapid solidification of the molten lead alloy, a continuous grid strip is formed and stripped from the drum upon rotation past the shoe. One example of a conventional continuous casting machine and the processing parameters associated therewith is disclosed in U.S. Pat. No. 4,349,067 issued to Wirtz, et al.

From studying the nature of grid defects attributable to con-cast processing, the most prevalent defects can be generally classified as either "metallurgical" or "mechanical". Metallurgical casting defects typically relate to improper grain size, equiaxed grains and/or grain boundaries which are primarily attributable to non-uniform solidification temperatures. Conversely, mechanical casting defects relate to cold knits, grid inclusions caused by dross (i.e., lead oxide), and voids caused by air entrapment or gas expansion in the mold cavity between the closely mating surfaces of the drum and shoe. Thus, it would be desirable to vent the mold cavity prior to delivery of the molten lead for purging trapped air and gas therefrom. However, unless the mating surfaces between the drum and shoe are maintained in close sliding engagement, the molten lead alloy will leak (i.e., flash) therebetween. Maintenance of such a close sliding contact is critical, yet difficult to control due to variations in thermal expansion of the casting drum across its entire width as molten lead alloy is directed into the mold cavity. Accordingly, it has been proposed heretobefore to provide a system for maintaining the drum temperature (i.e., a cooling system) during operation of the con-cast machine so as to eliminate or substantially minimize flash due to distortion of the casting drum. One example of a cooling system for a casting drum used with a continuous casting machine is disclosed in U.S. Pat. No. 4,489,772 to Wirtz, et al.

Despite the improvements presented by the last-mentioned Wirtz patent, the con-cast process still suffers from several drawbacks which significantly limit its production capacity as well as product quality and cost. In particular, to avoid the above-noted variations in thermal expansion of the casting drum, the size (i.e., width and diameter) of casting drums has heretobefore been limited which, in turn, limits the number of grid strips that can be concurrently cast (i.e., "side-by-side") on a single drum. Moreover, due to the high precision required for machining (i.e., engraving) the reticulated grid pattern into the outer peripheral surface of the drum, fabrication is expensive and defects commonly result in scrapping of the drum. Finally, conventional casting drums are not provided with any mechanism for removing entrapped air or gasses from within the mold cavity which are known to result in voids and inclusions in the grid.

SUMMARY OF THE INVENTION

Accordingly, the present invention is generally directed to a method and apparatus for manufacturing battery grids and, in particular, to an improved casting drum for use in casting lead alloy battery grids on a continuous casting machine. The casting drum of the present invention includes a segmental shell that is assembled from a series of interconnectable shell rings, with each ring having a portion of the patterned mold cavity machined into its outer peripheral surface. Thus, the individual rings can be fabricated and machined at a reduced cost and can be individually removed from and replaced in the assembled shell in the event of a defect or breakage.

As an additional object, the improved casting drum of the present invention is also used in association with a pressure control system for evacuating the mold cavity immediately prior to introduction of the molten lead alloy therein. The pressure control system can also be adapted to subsequently introduce pressurized air into the mold cavity for assisting in ejecting the solidified grid strip(s) therefrom.

In a preferred form, the segmental shell includes a series of flow pathways that communicate with the mold cavity and which can be alternately connected to a vacuum source for evacuating the mold cavity (immediately prior to introduction of the molten lead alloy) and to a pressure source for pressurizing the mold cavity (upon solidification of the grid strips) in response to rotation of the casting drum. Thus, a continuous cycle of evacuation and pressurization of the mold cavity is effectuated for producing superior quality battery grids.

It should be appreciated that while the segmental casting drum and the continuous casting machine are described in association with forming lead battery grid strips, the novel features of the present invention can be applied in conjunction with any molten media and mold patterns to form a variety of products.

Additional objects, advantages, and features of the present invention will become apparent from the following description and appended claims, taken in conjunction with the accompanying drawings.

BRIEF DESCRIPTION OF THE DRAWINGS

FIG. 4 is an enlarged partial view of a portion of the casting drum shown within line 4—4 of FIG. 3; and FIG. 5 is an enlarged end view of a portion of one of the rings.

DETAILED DESCRIPTION OF THE PREFERRED EMBODIMENT

Figure 1:
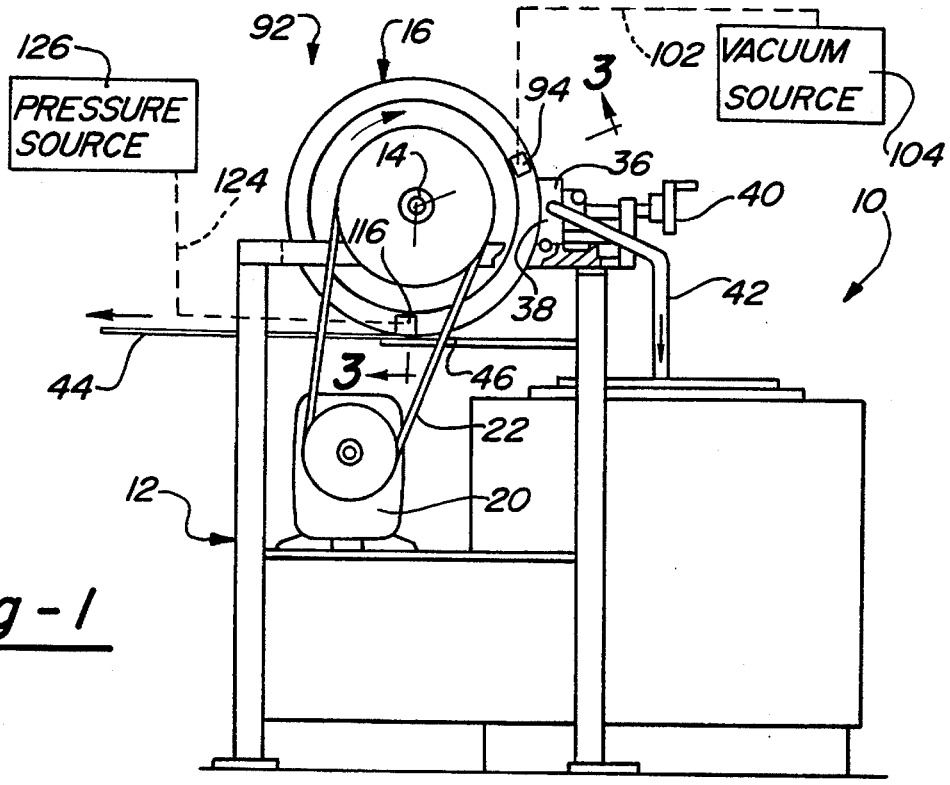
FIG. 1 is a side view of a continuous casting machine equipped with a segmental casting drum and pressure control system of the present invention.

In general, the present invention is directed to an improved casting drum used on a continuous casting machine for casting lead battery grid strips. In particular, the casting drum includes a circular cylindrical shell that is assembled from a plurality of interconnectable shell rings. This segmental or "modular" shell concept is a significant improvement over conventional casting drum technology in terms of reduced fabrication costs, increased service life, and the ability to assemble the rings to form different "side-by-side" grid strip configurations, thereby reducing manufacturing costs and required drum inventories. For purposes of this application, the terms "lead" and "lead alloy" are intended to identify any material commercially-used or contemplated for use in lead-acid battery grids that can be cast in a molten state.

As will be detailed, the casting drum and continuous casting machine of the present invention are improvements over that disclosed in U.S. Pat. No. 4,489,772 of which the Applicant is a named co-inventor, the entire disclosure of which is expressly incorporated by reference herein. However, the present invention significantly advances the level of technology by incorporating the novel concepts of a segmental shell design and utilization of a pressure control system for sequentially evacuating and pressurizing the mold cavity. Evacuation of the mold cavity immediately prior to delivery of molten lead thereto results in the removal of entrapped air or gasses from the mold cavity for significantly minimizing, if not eliminating, the formation of inclusions and voids in the battery grid strips. Moreover, such evacuation replaces the oxidizing atmosphere with an inert atmosphere that is more conducive to casting of high quality grid strip(s). In a similar fashion, subsequent pressurization of the mold cavity, following solidification of the molten lead, assists in ejecting the grid strip(s) from the casting drum. Such a forced ejection arrangement permits the use of reduced draft angles and reduces the amount of lubrication required to strip the grid strip(s) from the mold cavity. Since lubricating oil entrapped in the mold cavity is known to gasify, such a reduction is also considered highly advantageous.

As will also be described hereafter with greater detail, each shell ring includes a plurality of vent slots which provide a communication pathway between the mold cavity and internal flow channels extending across the entire length of the assembled shell. Upon rotation of the casting drum, a vacuum source is coupled to those internal flow channels enclosed by the shoe such that any undesirable oxidizing atmosphere can be evacuated from the corresponding portion of the mold cavity prior to delivery of the molten lead thereto. Following solidification of the lead and upon continued rotation of the casting drum, some flow channels downstream of the shoe are connected to a pressurized air source such that the solidified grid strip(s) are forcibly ejected from the mold cavity.

Figure 2:
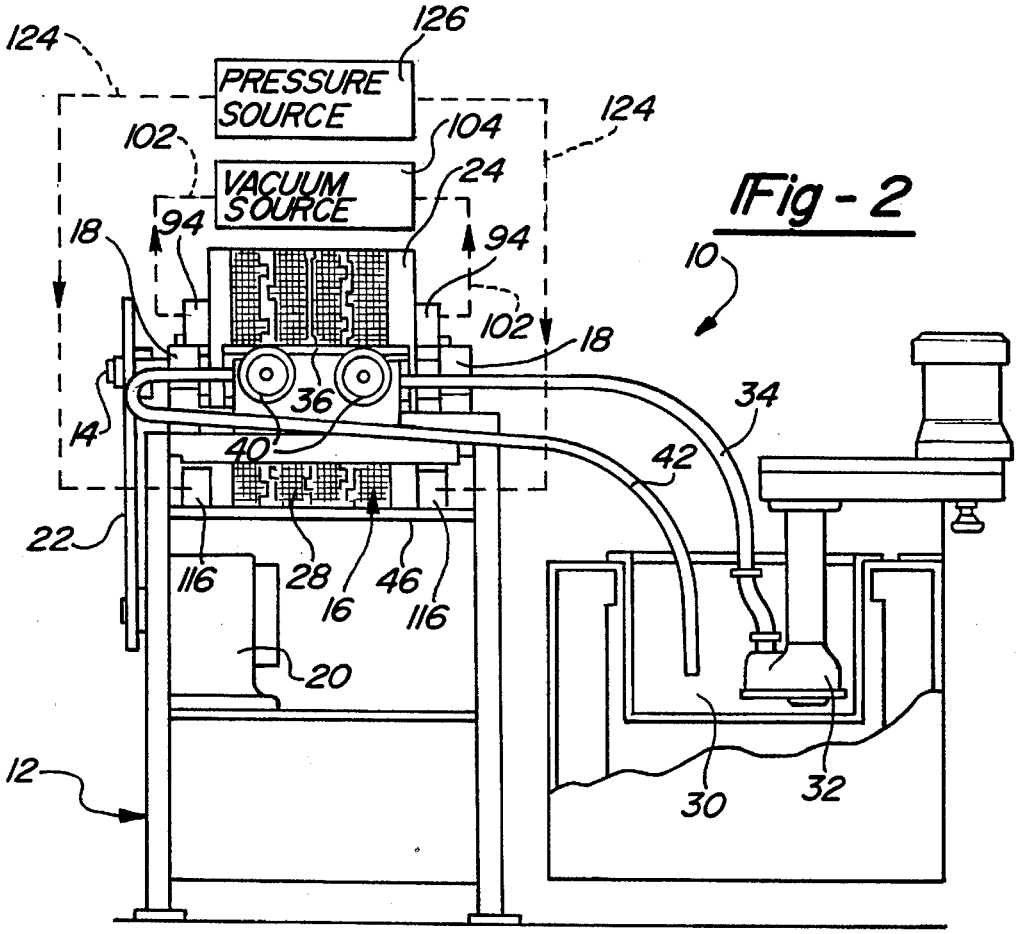
FIG. 2 is an end view of the continuous casting machine shown in FIG. 1.

Referring now to FIGS. 1 and 2 of the drawings, a continuous casting machine 10 is shown to include a frame 12 on which a shaft 14 of a casting drum 16 is journalled by pillow blocks 18 for rotation about a horizontal axis. Casting drum 16 is rotated at a desired speed by a suitable motor 20 and drive chain 22 arrangement. As will be detailed, casting drum 16 is an assembly of various components including a circular cylindrical shell 24 concentrically supported from shaft 14 for rotation therewith. Shell 24 is assembled from a plurality (i.e., two or more) of individual rings 26 that are interconnected in a juxtapositioned (i.e., "side-by-side") arrangement. Moreover, each ring 26 has a grid pattern machined into its outer peripheral surface to form a cavity segment. Each ring 26 can be individually machined or assembled as shell 24 for common machining. Upon alignment and registry of rings 26, their corresponding cavity segments are likewise aligned to form a mold cavity, cumulatively identified in FIG. 2 by reference numeral 28. As is known, mold cavity 28 defines the continuous grid pattern (i.e., reticulum and its lugged side borders) for a series of interconnected grids that are formed as a continuous grid strip upon operation of continuous casting machine 10. Preferably, casting drum 16 includes a mold cavity which defines a plurality of juxtapositioned grid strips for increased production capacity.

Molten lead from a pot 30 is directed by means of a motor-driven pump 32 through an inlet conduit 34 and into a shoe 36. Shoe 36 is mounted to frame 12 so as to be held stationary relative to casting drum 16 during operation of continuous casting machine 10. In addition, shoe 36 has an arcuate face surface 38 which mates with and overlays a portion of mold cavity 28 on the outer peripheral surface of drum 16. Suitable clamp screws 40 are utilized for maintaining face surface 38 of shoe 36 in a desired sliding contact engagement with the outer peripheral surface of casting drum 16. Within shoe 36 is an enlarged distribution chamber (not shown) having an elongated orifice slot (also not shown) which opens at face surface 38 and which extends across the entire width of mold cavity 28. The distribution chamber in shoe 36 has an inlet port or ports communicating with inlet conduit 34 and an outlet port or ports communicating with an outlet conduit 42. Preferably, positioned within this distribution chamber is a supplemental heating device that is in direct communication with the molten lead flowing therethrough for maintaining the molten lead at a desired homogeneous casting temperature. A preferred construction for such a supplemental heating arrangement is more thoroughly disclosed in copending and commonly owned U.S. application Ser. No. 08/249,874 filed Jul. 20, 1994, which issued on Mar. 12, 1996, as U.S. Pat. No. 5,497,822, and entitled "Shoe For Use On Continuous Casting Machine And Method Of Use", the entire disclosure of which is incorporated by reference herein.

In accordance with the operation of continuous casting machine 10, the molten lead is discharged through the discharge slot in shoe 36 for filling mold cavity 28 as drum 16 is rotated, thereby forming the desired lead battery grid strip(s) in a continuous manner. Any excess molten lead is directed back into pot 30 through outlet conduit 42. Upon continued rotation of casting drum 16, the solidified grid strip(s) 44 are stripped from mold cavity 28 and against a stop block 46 which serves to inhibit distortion thereof. Thereafter, grid strip(s) 44 are processed and then severed into individual battery grids. Preferably, mold cavity 28 of casting drum 16 is maintained at a uniform temperature below the melting temperature of the lead in order to quickly solidify the molten lead before the filled grid pattern rotates out of contact with shoe 36. Such temperature control is provided by a temperature control system generally similar to that disclosed in U.S. Pat. No. 4,489,772. In particular, shaft 14 is formed with an inlet passageway 50 that is adapted to be connected via a suitable pump and hoses to a fluid reservoir (not shown) containing a fluid, such as oil. Prior to the introduction of molten lead to shoe 36, drum 16 is rotated and heated oil is delivered to passageway 50 for pre-heating mold cavity 28. After lead dispersion begins, passageway 50 serves to distribute the same or a different fluid now acting as a coolant, to maintain mold cavity 28 at the desired temperature.

Figure 3:
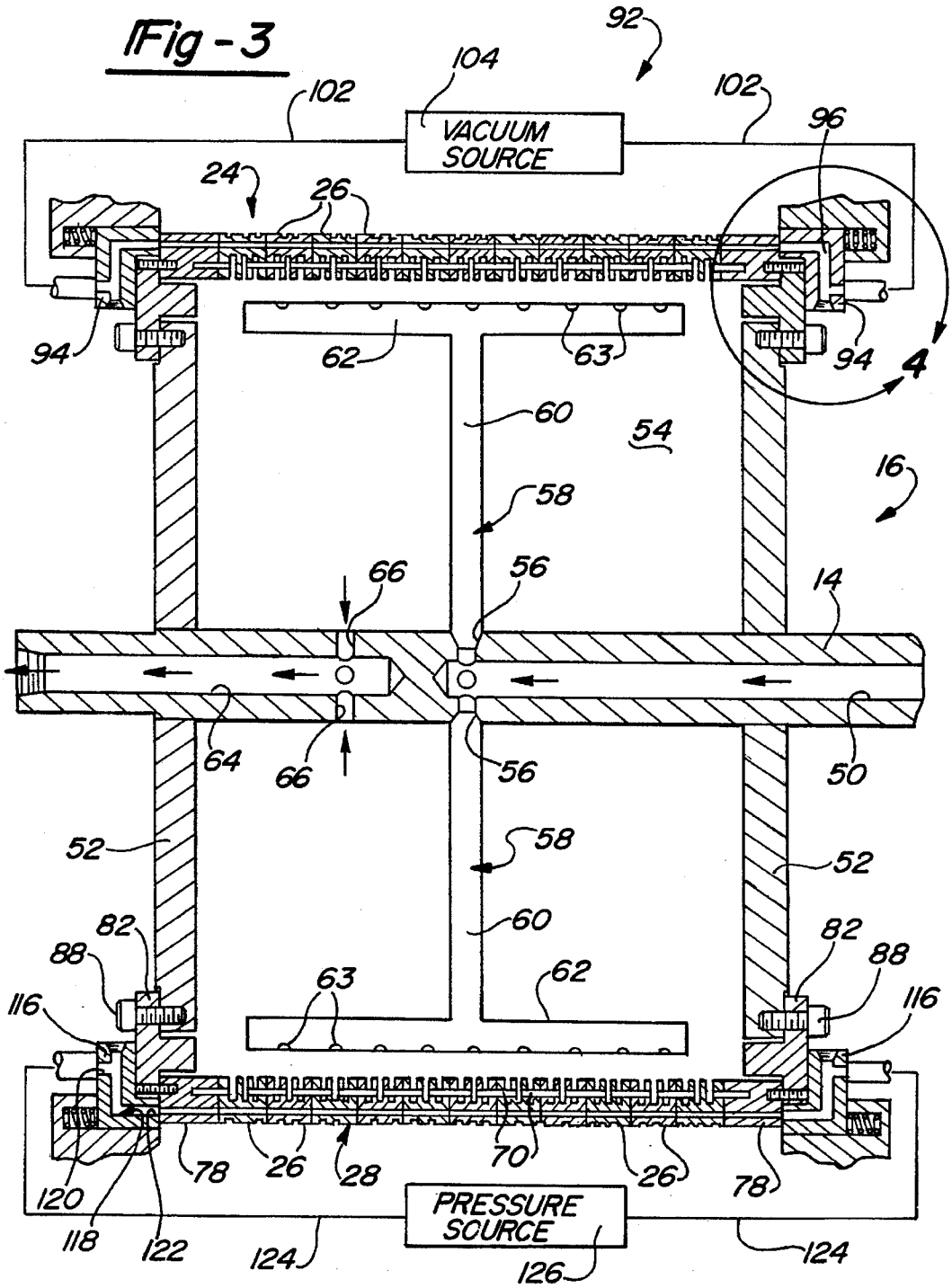
FIG. 3 is a sectional view of the casting drum taken along line 3—3 in FIG. 1.

As best seen from FIGS. 3 and 4, casting drum 16 includes a pair of circular mounting disks 52 that are fixed to shaft 14 in an axially-spaced relation. Shell 24 is fixed to the outer ends of mounting disks 52 so as to define an internal chamber 54 within drum 16. Inlet passageway 50 terminates inside of drum chamber 54 with its terminal end in communication with a plurality of radial ports 56. A T-shaped distribution pipe 58 is connected to each port 56 and includes a radial pipe segment 60 and a transverse pipe segment 62. Pipe segments 62 are oriented so as to be located adjacent, and generally parallel to, the inner peripheral surface of shell 24. Pipe segments 62 are shown to include a plurality of nozzle openings 63 which, when fluid under pressure is supplied to inlet passageway 50, causes the fluid discharged therefrom to be directed against the inner peripheral surface of shell 24. The opposite distal ends of each pipe segment 62 is capped such that fluid delivered through inlet passage 50 can only be discharged into drum chamber 54 via nozzle openings 63. As will be understood, any suitable number of radially oriented shaft ports 56 and distribution pipes 58 can be used with casting drum 16 of the present invention. The opposite end of shaft 14 is formed with an exhaust passageway 64 which communicates with interior chamber 54 of drum 16 by means of a series of radially-directed return ports 66. Exhaust passageway 64 is connected by an exhaust conduit (not shown) to the fluid reservoir such that fluid entering chamber 54 of drum 16 via inlet passageway 50 is subsequently exhausted from chamber 54 via return ports 66 and exhaust passageway 64. Thus, the temperature control system can be used to initially preheat casting drum 16 and then to maintain a desired drum temperature during operation of continuous casting machine 10.

In accordance with the novel principles of the present invention, and as best seen from FIGS. 3 through 5, a preferred construction for segmental shell 24 will now be described. In general, adjacent rings 26 are shown registrably aligned and interconnected by means of pins 70 which extend axially through alignable dowel bores 72 that are formed in both lateral face surfaces of each ring 26. More particularly, dowel bores 72 are equally-spaced and circumferentially aligned on both face surfaces of rings 26 for permitting juxtaposed interconnection of adjacent shell rings 26 via insertion of pins 70 in aligned dowel bores 72. Preferably, pins 70 are resilient roll pins fabricated from a rolled spring material with opposite edges spaced slightly apart so as to enable limited circumferential expansion and contraction. It will also be noted that a groove 74 is formed in the same lateral face surface of each shell ring 26. An O-ring 76 is mounted within groove 74 for establishing a fluid-tight seal between adjacent shell rings 26. As will be appreciated, interconnection of adjacent shell rings 26 via roll pins 70 is adapted to inhibit relative rotation therebetween and to align adjacent cavity segments to establish the desired mold cavity 28.

Following registered assembly of shell rings 26 in the desired order, an end ring 78 is interconnected to each of the outermost shell rings 26 via insertion of a roll pins 70 into aligned shell ring dowel bore 72 and end ring dowel bores 80. Thereafter, an annular clamp ring 82 is secured to each end ring 78 for permitting releasable interconnection of end rings 78 to mounting disks 52. As best seen in FIG. 4, a series of dowel pins 84 are inserted into circumferentially-spaced end ring dowel holes 83 and clamp ring dowel holes 85 for aligning and securing end rings 78 to clamp rings 82. If desired, pins 84 could alternative be replaced by suitable threaded fasteners with holes 83 and 85 having internal threads. Finally, annular clamp rings 82 are shown releasably secured to a recessed outer face surface 86 of mounting disks 52 by means of threaded fasteners 88. O-rings 89 provide a fluid-tight sealed connection between mounting disks 52 and clamp rings 82. Likewise, O-rings 90 provide a fluid-tight sealed connection between clamp rings 82 and end rings 78. Thus, when assembled, segmental shell 24 includes shell rings 26, end rings 78 and clamp rings 82.

In accordance with the present invention, a pressure control system 92 is provided in association with continuous casting machine 10 for the purpose of evacuating a portion of mold cavity 28 covered by shoe 36 and located upstream of the shoe distribution slot immediately prior to introduction of the molten lead to mold cavity 28. As noted, such cavity evacuation results in the removal of undesirable oxidizing atmosphere and/or any gasses, thereby significantly minimizing or potentially preventing, the formation of inclusions and voids in the solidified grid strip(s) 44. According to the embodiment disclosed, pressure control system 92 includes a pair of vacuum manifolds 94 that are each fixed to frame 12 in proximity to the opposite ends of shoe 36. In particular, vacuum manifolds 94 are secured to frame 12 so as to be positioned adjacent the opposite lateral sides of casting drum 16. More specifically, each vacuum manifold 94 is mounted to be in close proximity to a corresponding end ring 78 and clamp ring 82. Thus, since casting drum 16 is supported to rotate relative to frame 12, a sliding contact is established between segmental shell 24 and vacuum manifolds 94.

Each vacuum manifold 94 has a passageway 96 having an inlet 98 and an outlet 100. Outlet 100 is connected via vacuum hose 102 to a vacuum source, diagrammatically shown in the drawings by block 104. Vacuum source 104 is adapted to draw a vacuum (i.e., a negative pressure condition) through passageway 96. While schematically shown, it will be appreciated that vacuum source 104 can be any suitable vacuum motor or an equivalent device mounted to frame 12 of continuous casting machine 10. To provide means for establishing a communication pathway between passageway 96 of each vacuum manifold 94 and mold cavity 28, end rings 78 include a series of equally-spaced and circumferentially-arranged flow channels 106 that communicate with a like number of circumferentially-arranged flow channels 108 formed through each shell ring 26. Thus, upon assembly of segmental shell 24, flow channels 106 and 108 cumulatively define a series of pathways 110 that extend across the entire width of casting drum 16.

Flow channels 106 and 108 are preferably shown as a series of through-bores that are aligned upon insertion of roll pins 70 into shell ring dowel bores 72 and end ring dowel bores 80. Thus, as casting drum 16 rotates relative to frame 12 and vacuum manifolds 94, the continuous pathways 110 established by flow channels 106 and 108 come sequentially into and out of communication with inlet 98 of vacuum manifolds 94. End rings 78 and clamp plates 82 are arranged to have a close sliding contact with vacuum manifolds 94 for maintaining communication between inlet 98 of vacuum manifold 94 at flow pathways 110 across shell 24. As seen from FIG. 5, inlet 98 is preferably configured as an elongated slot 112 that is sized to fluidly communicate with two flow pathways 110 at a time. Obviously, the length of slot 112 is dependent on the length of arcuate surface 38 of shoe 36 which is located upstream of the shoe's discharge orifice.

To provide means for establishing communication between flow pathways 110 and mold cavity 28, each shell ring 26 has a series of thin vent slots 114 formed along one radial edge thereof which communicates with flow channels 108. As best seen from FIG. 5, each vent slot 114 communicates with a corresponding one of the circumferentially-spaced flow channels 108 formed in each shell ring 26. Vent slots 114 are extremely narrow in width so as to permit the vacuum to be drawn for purging mold cavity 28, yet without enabling the flow of molten material therein. As can be seen, O-rings 76 provide a fluid-tight sealed connection to inhibit fluid within drum chamber 54 from being drawn into flow pathways 110 and vacuum manifold 94 as well as to inhibit such fluid from reaching mold cavity 28. In a preferred form, vent slots 114 are milled in one radial edge of each shell ring 26. However, it is contemplated that various other methods of providing communication between flow channels 108 and mold cavity 28 are reasonably within the fair scope of the present invention.

In accordance with another feature of the present invention, fluid pressure control system 92 can further be adapted to include a pair of ejector manifolds 116 which, preferably, are substantially similar in construction to that of vacuum manifolds 94. In particular, each ejection manifold 116 includes a passageway 118 having an inlet 120 and an outlet 122. Inlet 120 is coupled to an air hose 124 which, in turn, is coupled to the outlet of a source of pressurized air, diagrammatically shown in the drawings as block 126. Again, any suitable compressor or equivalent device can be mounted to frame 12 of continuous casting machine 10, if so desired. Thus, pressurized air is delivered to mold cavity 28 via flow pathways 110 and vent slots 114 upon rotation of casting drum 16 past shoe 36. To this end, ejection manifolds 116 are located downstream of shoe 36 and adjacent to stop block 46 for injecting pressurized air between the solidified grid strips 44 and mold cavity 28. In this manner, pressurized air is used for forcibly ejecting grid strips 44 from mold cavity 28. In accordance therewith, this forced ejection system allows reduced draft angles for minimizing the one-sided effect of grid strips formed on con-cast machines.

It is to be understood that the positioning of injection manifolds 116 may vary depending on where grid strips 44 are ejected. Moreover, while the specific embodiment shown discloses the use of a pair of vacuum manifolds 94 and ejection manifolds 116, only one of each may be used if the application is warranted. In such an arrangement, one end of pathways 110 would be plugged to provide efficient vacuum draw and ejection pressurization. Preferably, an aligned pair of matching vacuum manifolds 94 and ejection manifolds 116 are used to insure complete evacuation and/or ejection across the entire width of mold cavity 28.

In accordance with yet another advantageous feature of the present invention, segmentation of casting drum 16 into individual rings 26 results in decreased manufacturing costs in conjunction with improved drum quality. In particular, the current process used for hardening the casting drum after machining is to harden the surface using a laser to prevent distortion of the drum. Unfortunately, use of a laser for surface hardening creates overlapping zones of hardness and annealed softness (i.e., stripes) due to the casting drum being rotated and indexed under the fixed beam. When a soft zone lands on the edge of a pillow in the reticulum pattern, premature metal failure occurs. Additionally, laser hardening utilizes a laser beam operating at a constant energy level that is selected to effectuate the desired hardness and depth. However, because the amount of metal available to absorb such energy varies with the geometry of the reticulum, corner and small sections can be burnt if the energy source is not properly adjusted. Accordingly, use of laser hardening processing results in compromised drum hardness characteristics. In contrast, the segmental ring system of the present invention allows the use of conventional induction or flame hardening techniques, similar to that used in ring gear production, for providing full-depth, uniform hardening. Moreover, a damaged ring can be easily replaced in the assembled shell without necessitating the scrapping of the entire casting drum.

While the present invention is particularly well-suited for continuous casting of lead battery grids for lead-acid battery applications, it is contemplated that the segmented casting drum and corresponding method of operation can be used for casting other products. Regardless, the present invention is a significant advancement over the current level of technology in the field of continuous casting and, as such, is anticipated to promote enhanced production capacity while concomitantly increasing the product quality. Whereas a particular embodiment of the invention has been described above, for purposes of illustration, it will be evident to those skilled in the art that numerous variations of the details may be made and combined without departing from the invention as defined in the appended claims.

What is claimed is:

1. A continuous casting machine comprising:

a casting drum including a shaft, a cylindrical shell having a mold cavity on the outer peripheral surface thereof, and mounting means for mounting said shell for rotation with said shaft, said shell being assembled from a plurality of registrably interconnectable shell rings each having a segment of said mold cavity formed thereon;

a shoe having an outer surface overlying said mold cavity, an inlet, an outlet, a passageway extending between said inlet and outlet, and a discharge slot extending between said passageway and said outer shoe surface;

a source of molten casting material;

a supply line interconnecting said source of molten casting material to said shoe inlet;

a return line interconnecting said shoe outlet to said source of molten casting material;

means for rotating said shaft for moving said mold cavity past said discharge slot in said shoe surface; and means for directing said molten casting material at a desired pressure and flow rate from said source through said supply line and said inlet to said passageway.

2. The machine of claim 1 wherein said mounting means defines an enclosed chamber between said shell and said shaft, said shaft having an inlet and an outlet both coupled to a fluid supply system, a plurality of radially extending pipes coupled to said inlet for distributing fluid within said enclosed chamber of said drum, and said outlet adapted to return fluid to said fluid supply system.

3. The machine of claim 1 wherein said mounting means includes:

a pair of mounting disks fixed to said shaft;

a pair of clamp rings attached to said mounting disks; and a pair of end rings attached to said clamp rings with said shell being mounted on said end rings.

4. The machine of claim 1 wherein said shell includes a plurality of flow pathways communicating with said mold cavity, and further comprising a pressure control system for sequentially coupling said flow pathways with a vacuum source upon rotation of said casting drum for evacuating a portion of said mold cavity upstream of said shoe discharge slot prior to delivery of said molten casting material thereto.

5. The machine of claim 4 wherein said pressure control systems includes a vacuum manifold in fluid communication with said vacuum source and at least one of said flow pathways upon rotation of said drum for evacuating a corresponding portion of said mold cavity.

6. The machine of claim 4 wherein said flow pathways includes circumferentially-arranged flow channels extending through each shell ring and which are alignable upon assembly of said shell, and circumferentially-arranged vent slots formed in each shell ring which communicate with a corresponding one of said flow channels.

7. The machine of claim 6 wherein said pressure control system further includes a source of pressurized air that is placed in communication with at least one of said flow pathways downstream of said shoe upon rotation of said drum for injecting pressurized air into said mold cavity to eject the solidified product therefrom.

8. A continuous casting machine comprising:

a casting drum having a continuous mold cavity formed on the outer peripheral surface thereof, said casting drum including a plurality of flow pathways extending from at least one side of said drum and communicating with said mold cavity;

a shoe having an outer surface overlying said mold cavity, an inlet, and outlet, a passageway extending between said inlet and outlet, and a discharge slot extending between said passageway and said outer shoe surface;

a source of molten casting material;

a supply line interconnecting said source of molten casting material to said shoe inlet;

a return line interconnecting said shoe outlet to said source of molten casting material;

means for directing said molten casting material at a desired pressure and flow rate from said source through said supply line and said inlet to said passageway for delivery through said discharge slot in said mold cavity;

means for rotating said casting drum relative to said shoe for moving said mold cavity past said discharge slot in said shoe surface; and a pressure control system in communication with said flow pathways in said casting drum for evacuating said mold cavity prior to delivery of said molten casting material thereto.

9. The machine of claim 8 wherein said pressure control system includes a vacuum source that communicates with at least one flow pathway upstream of said shoe discharge slot for drawing a vacuum therethrough to evacuate the portion of said mold cavity associated with said flow pathway.

10. The machine of claim 9 wherein said pressure control system further comprises a pressure source that communicates with at least one flow pathway downstream of said shoe for injecting a pressured gas into said mold cavity to assist in ejecting the solidified cast product therefrom.

11. The machine of claim 10 wherein said pressure control system includes an ejection manifold in communication with a source of pressurized air and at least one of said flow passageways upon rotation of said drum for injecting pressurized air into said mold cavity to eject said solidified products therefrom.

12. The machine of claim 8 wherein said casting drum includes a shaft rotatably driven by said rotating means, a cylindrical shell having said mold cavity on its outer peripheral surface, and mounting means for mounting said shell on said shaft for rotation therewith, said shell being assembled from a plurality of registrably interconnectable shell rings each having a segment of said mold cavity formed thereon.

13. The machine of claim 12 wherein said mounting means defines an enclosed chamber between said shell and said shaft, said shaft having an inlet and an outlet both coupled to a fluid supply system, a plurality of radially extending pipes coupled to said inlet for distributing fluid within said enclosed chamber of said drum, and said outlet adapted to return fluid to said fluid supply system.

14. The machine of claim 12 wherein said shell includes said plurality of flow pathways which communicate with said mold cavity, and wherein said pressure control system sequentially couples said flow pathways with a vacuum source upon rotation of said casting drum for evacuating a portion of said mold cavity upstream of said shoe discharge slot prior to delivery of said molten casting material thereto.

15. The machine of claim 14 wherein said pressure control systems includes a vacuum manifold in fluid communication with said vacuum source and at least one of said flow pathways upon rotation of said casting drum for evacuating a corresponding portion of said mold cavity.

16. The machine of claim 14 wherein said flow pathways includes circumferentially-arranged flow channels extending through each shell ring and which are alignable upon assembly of said shell, and circumferentially-arranged vent slots formed in each shell ring which communicate with a corresponding one of said flow channels.

17. In a continuous casting machine of the type having a casting drum with a mold cavity formed on the outer peripheral surface thereof and which is rotatable relative to a shoe provided for delivering a molten casting material from a source of molten casting material into the mold cavity, said casting drum includes a shell assembled from a series of interconnected ring segments each having a portion of said mold cavity formed on its outer peripheral surface.

18. The drum of claim 17 further comprising mounting means for mounting said shell to a shaft, said mounting means includes:

a pair of mounting disks fixed to the shaft;

a pair of clamp rings attached to said mounting disks; and a pair of end rings attached to said clamp rings with said shell being mounted on said end rings.

19. The drum of claim 17 wherein said shell includes a plurality of flow pathways communicating with said mold cavity, said flow pathways are sequentially coupled with a vacuum source upon rotation of said casting drum for evacuating a portion of said mold cavity prior to delivery of the molten casting material thereto.

20. The drum of claim 19 wherein said flow pathways includes circumferentially-arranged flow channels extending through each ring segment and which are alignable upon assembly of said shell, and circumferentially-arranged vent slots formed in each ring segment which communicate with a corresponding one of said flow channels.

21. The drum of claim 19 wherein said flow pathways are sequentially coupled to a pressurized air source upon rotation of said drum for injecting pressurized air into said mold cavity downstream of the shoe to eject the solidified cast product therefrom.

22. In a continuous casting machine of the type having a casting drum with a mold cavity formed on a surface thereof and which is movable relative to a shoe in fluid communication with a source of molten casting material, said casting drum including a plurality of flow passageways extending from at least one side of said drum and communicating with said mold cavity through openings extending from each passageway to said mold cavity.

23. The drum of claim 22 comprised of a series of interconnectable shell rings each having a portion of said mold cavity formed on its outer surface.

24. The drum of claim 22 wherein at least one of said flow passageways is placed in fluid communication with a vacuum source upon rotation of said drum relative thereto for evacuating a corresponding portion of said mold cavity.

25. The drum of claim 24 wherein at least one of said passageways is placed in communication with a pressurized air source upon rotation of said drum for discharging pressurized air into said mold cavity to eject solidified products therefrom.

* * * * *